US006267422B1

(12) United States Patent
Alba

(10) Patent No.: US 6,267,422 B1
(45) Date of Patent: Jul. 31, 2001

(54) SIDE MOUNT HOIST RING

(75) Inventor: Tony J. Alba, West Covina, CA (US)

(73) Assignee: CBC Industries, Inc., City of Commerce, CA (US)

( * ) Notice: Subject to any disclaimer, the term of this patent is extended or adjusted under 35 U.S.C. 154(b) by 0 days.

(21) Appl. No.: 09/339,070

(22) Filed: Jun. 23, 1999

(51) Int. Cl.[7] ..... B66C 1/66
(52) U.S. Cl. ..... 294/1.1; 294/89; 403/78
(58) Field of Search ..... 294/1.1, 82.1, 294/89; 403/78, 79, 119, 164

(56) References Cited

U.S. PATENT DOCUMENTS

| | | | | |
|---|---|---|---|---|
| 3,371,951 | * | 3/1968 | Bryant | 294/89 |
| 3,628,820 | * | 12/1971 | Blatt | 294/1.1 |
| 4,145,874 | | 3/1979 | Muller et al. . | |
| 4,641,986 | | 2/1987 | Tsui et al. . | |
| 4,684,280 | | 8/1987 | Dirkin et al. . | |
| 4,705,422 | | 11/1987 | Tsui et al. . | |
| 5,024,283 | | 6/1991 | Deli . | |
| 5,046,881 | | 9/1991 | Swager . | |
| 5,320,443 | | 6/1994 | Lien et al. . | |
| 5,405,210 | | 4/1995 | Tsui . | |
| 5,525,001 | | 6/1996 | Perkins . | |
| 5,560,664 | * | 10/1996 | Lotze et al. | 294/1.1 |
| 5,848,815 | | 12/1998 | Tsui et al. . | |
| 6,039,500 | * | 3/2000 | Kwon | 294/1.1 |
| 6,068,310 | * | 5/2000 | Fuller et al. | 294/1.1 |

FOREIGN PATENT DOCUMENTS

| | | | | |
|---|---|---|---|---|
| 2704-732 | * | 8/1978 | (DE) | 294/1.1 |
| 179-733 | * | 4/1986 | (EP) | 294/1.1 |
| WO 93/20359 | | 10/1993 | (WO) . | |

* cited by examiner

*Primary Examiner*—Dean J. Kramer
(74) *Attorney, Agent, or Firm*—Bruce A. Jagger

(57) ABSTRACT

A side mount hoist ring assembly adapted to swivel through a full 360 degrees and pivot through a full 180 degrees that is more economical and simple to fabricate since the pivot axis is offset a distance from the swivel axis. The lift comprises a body, a cylindrical bushing, a load bearing flange, a closed lifting loop, and a threaded mounting member. Lifting loads exerted on the lifting loop induce bending stress on the mounting member which are compensated for by the load bearing flange.

7 Claims, 3 Drawing Sheets

10
18
46
44
42
22
20
12
32
64
28
64
30
26
24
36
14
52
16
"C"
50

SIDE MOUNT HOIST RING

BACKGROUND OF THE INVENTION

1. Field of the Invention

The invention relates in general to hoist rings and, in particular, to a side mount hoist ring adapted to be mounted on an object to be lifted. The side mount hoist ring is adapted to swivel through a full 360 degrees and pivot through a full 180 degrees, is more economical to fabricate than comparable center mount hoist ring assemblies, and maintains or exceeds the load capacity of a comparable size center mount hoist ring assembly.

2. Description of the Prior Art

Various hoist ring assemblies have been proposed previously. Recently there has been a need to develop hoist ring assemblies that are attachable to objects to be lifted while being able to continuously swivel 360 degrees in one direction and tilt approximately 180 degrees in another. Hoist ring assemblies having these properties have been found very desirable by industry. For example, in Tsui et al U.S. Pat. No. 4,705,422, and Tsui et al U.S. Pat. No. 5,848,815 such swiveling and tilting hoist ring assemblies are disclosed.

It is well known that machining operations on parts are expensive in time and materials. Forgings are much quicker and easier to produce with substantially less waste in material. For hoist ring assemblies having large load carrying capacities, many of the parts must be forged for strength, and then machined to their final dimensions. The prior art assemblies generally require numerous machining operations, and their designs are not readily adaptable for use with "as forged" parts. In particular, the close tolerances generally required in prior configurations could not be made from forgings without several expensive machining operations.

One attempt to solve the problem is Tsui U.S. Pat. No. 5,405,210 where a swiveling and tilting hoist ring assembly is disclosed in which the hoist ring member and retainer member are formed by forging and are assembled in the as forged condition. However, this hoist ring assembly follows the conventional wisdom of making the hoist ring pivot directly on top of the swivel axis. This type of configuration, herein referred to as a center pull hoist ring assembly, requires the shaping of complicated forged parts.

Previous swiveling and pivoting side pull hoist ring assemblies have been proposed. One prior art side pull hoist ring assembly utilizes a large circular ring that pivotally engages an outwardly elongated channel in the main body of the assembly. The size of the elongated channel, starting from its location in the center portion of the body, tapers outwardly to a large size at the end portions of the body in order to allow the circular hoist ring to pivot within the channel. However, due to the manner in which stress is distributed through the circular ring and elongated channel, for a given size, the load capacity of the assembly is significantly less than a comparably sized center pull hoist ring. Thus, this previous swiveling and pivoting side pull hoist ring assembly utilizing a circular hoist ring is undesirably limited to medium load capacities compared to equivalently sized center pull hoist ring assemblies.

Attempts to increase the load capacity of a swiveling and pivoting side mount hoist ring assemblies have also been made. Instead of utilizing a circular hoist ring, a semi-circular hoist ring, or "D" ring, is used. The semi-circular hoist ring has a generally straight segment engaging a U-shaped channel in the body of the assembly. Although, for a given sized assembly, the straight segment and U-shaped channel act to somewhat enhance the load capacity compared to the use of the circular ring, the semi-circular portion of the ring can still undesirably flex, due to bending stresses imposed during lifting. This flexing limits the load capacity of the assembly. Another problem with the previous swiveling and pivoting side mount hoist ring assemblies is that the lift ring is only captively restrained in the assembly when the assembly is mounted to the flat surface of an object. Undesirably, these prior art assemblies rely on the surface of the lifting object to retain the lift ring. Thus, when uninstalled, undesirably, the ring can be misplaced or lost. In addition, due to the swiveling nature of the assembly, the area of the surface of the object must not only be flat, but the area of the flat surface must also be large enough to prevent the ring from escaping from the assembly when swiveling.

Those concerned with these problems recognize the need for an improved simpler, less expensive, and easier to forge, swiveling and tilting side mount hoist ring assembly.

These and other difficulties of the prior art have been overcome according to the present invention.

BRIEF SUMMARY OF THE INVENTION

Side pull hoist ring assemblies according to the present invention swivel through a full 360 degrees, pivot through a full 180 degrees, and can be used to lift objects at their full rated capacity in any direction. These side pull hoist ring assemblies are designed so that they can be constructed mostly from forgings which are either used as forged or are forged to near net shapes. only simple and inexpensive turning and boring operations are needed to achieve the required final configurations. Milling and broaching operations, for example, are not required to execute the present invention. Significant savings in materials, operations, time and energy are thus realized.

The advantages of the present invention are realized, for example, by offsetting the pivotal axis of the lift ring by an offset distance from the longitudinal axis about which the body of the hoist ring swivels, while providing for the wide distribution of loads over the surface of the object to which the hoist ring assembly is mounted. This longitudinal axis is generally coextensive with the centerline of the mounting member, preferably a screw, which mounts the hoist ring assembly to the desired object. The longitudinal axis about which the body of the hoist ring assembly rotates does not intersect the lateral axis about which the lift ring pivots. There is thus formed a short moment arm that extends radially between the pivotal axis of the lift ring and the longitudinal axis about which the system swivels.

It has been found that this short moment arm can be compensated for in the design so that it does not adversely affect the utility, strength, or safety of the hoist ring assembly. Significant simplification of the design, as well as other advantages, are achieved by the present invention which permits the offsetting of the pivotal mounting of the lift ring from the centerline of the mounting screw.

The entire hoist ring assembly, including the lift ring, consists, for example, of only five parts. A wide preferably annular load-bearing flange is provided. The load bearing flange extends outwardly from the centerline of the screw for a distance that is at least equal to or greater than the length of the offset distance between the centerline of the mounting screw and the pivot axis of the lift ring. This load-bearing flange is adapted to bear on the surface of the object to which the hoist ring assembly is attached, and to retain the lift ring in operative association with the body of the hoist ring. When, for example, an annular flange is employed, the annular footprint it provides on the object is concentric with and preferably larger in diameter than the diameter defined by the offset distance between the longitudinal and lateral axis as the hoist ring swivels through 360 degrees. Advantageously, the moment arm effect of the offset lifting loads is minimized when the annular footprint is larger than the diameter defined by the offset distance.

It has also been found that the mating surfaces between the lift ring and the body of the hoist ring assembly do not need to conform to close tolerances. The accuracy achieved by forging is adequate. The cooperating structure for the offset mounting is very simple and rugged, and does not require critical close tolerances. It, for example, consists of a generally straight or linear U-shaped channel in the body of the hoist ring assembly that is adapted to pivotally receive a generally linear, preferably annular cross-sectioned segment of the lift ring. The generally straight or linear U-shaped channel extends generally normal to, and offset from, the centerline of the mounting bolt. The U-shaped channel can easily be achieved during the forging of the body. The open end of the generally straight U-shaped channel is wide enough to receive the generally linear segment of the lift ring, and is adapted to being at least partially closed by the wide annular flange in order to captively restrain the lift ring. The linear segment of the lift ring is thereby pivotally trapped in the U-shaped channel of the hoist ring body.

The segments of the lift ring are preferably continuous with one another so as to define a closed geometric figure with at least one straight segment having a generally round cross-section. Preferably, the lift ring includes two pull segments that, in combination with the lift segment, establish a triangle configuration. The triangle configuration of the lift ring desirably eliminates bending stresses inherent to prior art circular or semi-circular lift rings. The at least partially round lift segment is pivotally socketed in the U-shaped channel and is captively retained there by the wide annular flange. The wide annular flange thus serves to distribute the load, and to secure the lift ring together with the body of the hoist ring assembly. The wide annular flange is preferably integral with and extends radially from the distal end of a generally cylindrical bushing so that the flange and bushing are all one piece.

The generally cylindrical bushing is adapted to be mounted in a generally concentric relationship with the centerline of the mounting screw, and is adapted to receive the mounting screw there through. The hoist ring body includes a cylindrical bore, which is adapted to receive the outside diameter of the generally cylindrical bushing. The bushing is slightly longer than the depth of the cylindrical bore in the body. The head of the mounting screw is provided with an annular bearing surface that is positioned to bear, through a bearing washer, against the proximal end of the generally cylindrical bushing.

When the mounting screw is torqued down to a object, the load is transferred from the annular bearing surface of the mounting screw head, through the bearing washer, from the proximal to the distal end of the bushing, and into the wide annular flange, whereby it is distributed across the surface of the object in a pattern which is generally defined by the generally annular footprint of the wide annular flange. The body is journaled on the outer cylindrical surface of the bushing, and remains free to revolve around the centerline of the mounting screw. The bushing is slightly longer than the depth of the bore in the body so that the load-bearing washer does not bear axially against the body as the mounting screw is tightened down. The bore in the body can be countersunk, if desired, so that the bushing is shortened.

The surfaces of the integral wide flange-cylindrical bushing, the mating face of the body that bears against the wide annular flange, the bore in the body of the hoist ring assembly that receives the bushing, the bearing washer, and the mounting screw need to be held to tolerances which are closer than those that can generally be achieved in forging operations. These surfaces are required to reliably and consistently transmit loads, or to permit the smooth swiveling of the hoist ring assembly. No machining operations are required to accommodate the pivoting of the lift rings linear segment in the U-shaped channel. The mounting screw and bearing washer are preferably of conventional designs that are widely available as staple articles of commerce. The other parts and surfaces are preferably forged to a near net shape, and then machined to the required dimensions by simple turning and boring operations. Excessive scrap and expensive machining operations are thus avoided. The lift ring and U-shaped channel are preferably used as forged.

The hoist ring assembly of the present invention is preferably constructed from steel. Preferably, the base and closed loop lifting ring are made by the process of forging. Other materials can be used if a particular proposed end use so dictates. Where sparks must be avoided, for example, in explosive environments and the like, brass or plastic, for example, can be used, but with a very substantial sacrifice in strength.

The body is configured so that the cross-section of the body, which resists those shear forces that are applied by the lift ring, is always greater than the combined cross-sectional area of the legs of the lift ring. This configuration pertains in every pivotal position of the lift ring throughout its entire 180 degree range of motion. In every pivotal position that the lift ring can assume, there is an excess of cross-sectional area present in the body, which is available to resist shear loads.

The lift ring can assume any desired configuration so long as it retains the capacity to pivot within the channel in the body. Typically, there are two legs joined to opposed ends of the linear section, and those legs are in turn joined at there opposite ends to form a closed continuous figure. The lift ring can take the form of a D-shaped ring, a square ring, a triangular ring with rounded apices, or the like. For purposes of simplicity and ease of construction, the lift rings are preferably continuous closed objects. In some embodiments it is, however, desirable to have a multi-part lift ring that can, for example, be removed from the body without un-mounting the body from the object.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of hoist ring assemblies. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE EMBODIMENTS

Figure 1:
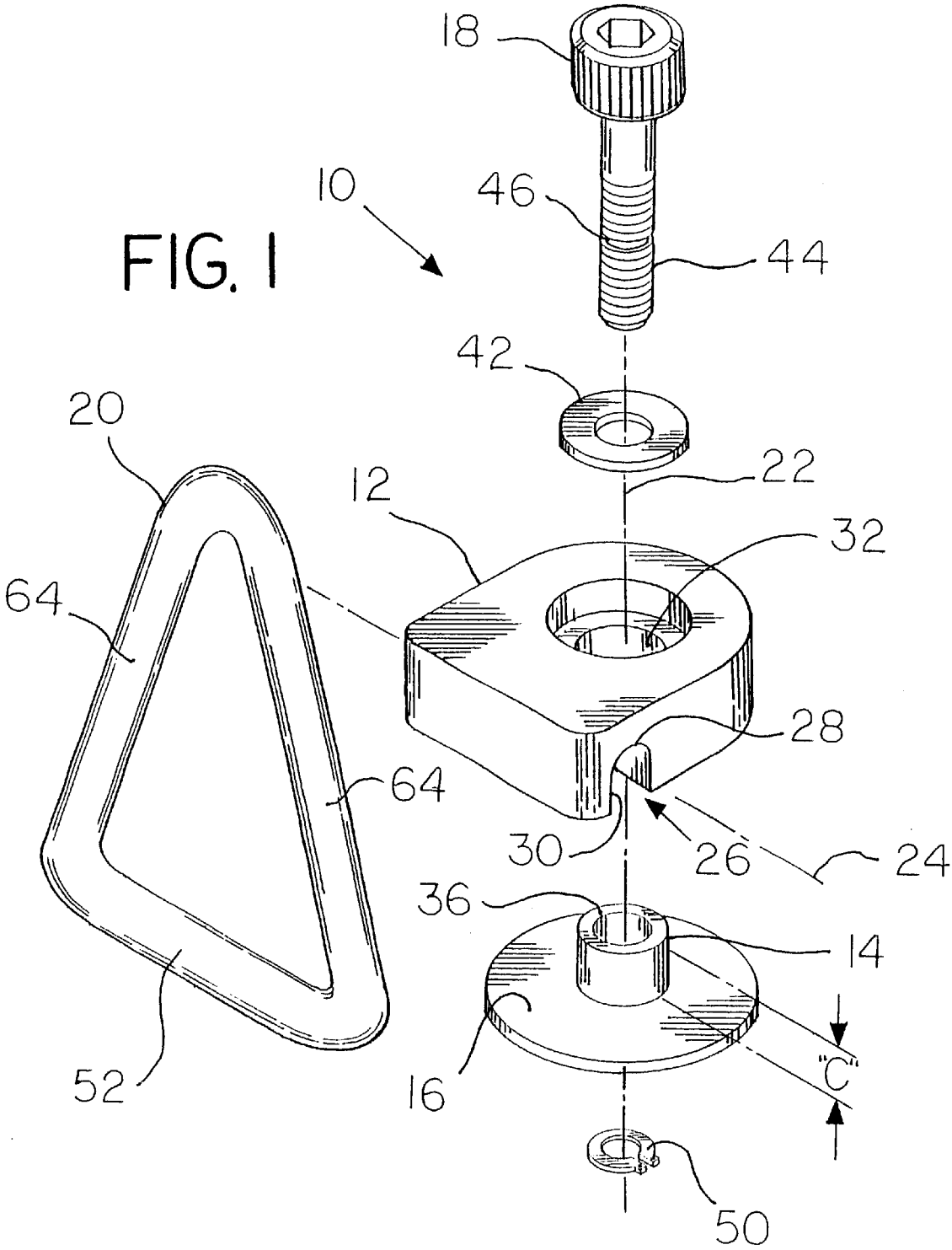
FIG. 1 is an exploded view of the parts prior to assembly of a preferred embodiment of the invention.

Referring now to the drawings wherein like reference numerals designate identical or corresponding parts throughout the several views.

Referring particularly to the drawings, there is illustrated generally at 10 a side pull hoist ring assembly. The side pull hoist ring assembly 10 includes a body 12, a cylindrical bushing 14, a load bearing flange 16, a mounting member 18, and a lift ring 20.

The body 12 includes a longitudinal axis 22 and a lateral axis 24 that do not intersect. The lateral axis 24 is generally normal to the longitudinal axis 22 and the two axes are offset from each other by an offset distance noted by dimension "A". The body includes a generally U-shaped linear channel 26 extending generally along the lateral axis 24. The U-shaped linear channel has a generally arcuate bottom 28 and an open mouth 30. A generally cylindrical bore 32 is provided in the body 12 extending generally concentrically with the longitudinal axis 22. The generally cylindrical bore 32 has an axial length noted as dimension "B".

Figure 2:
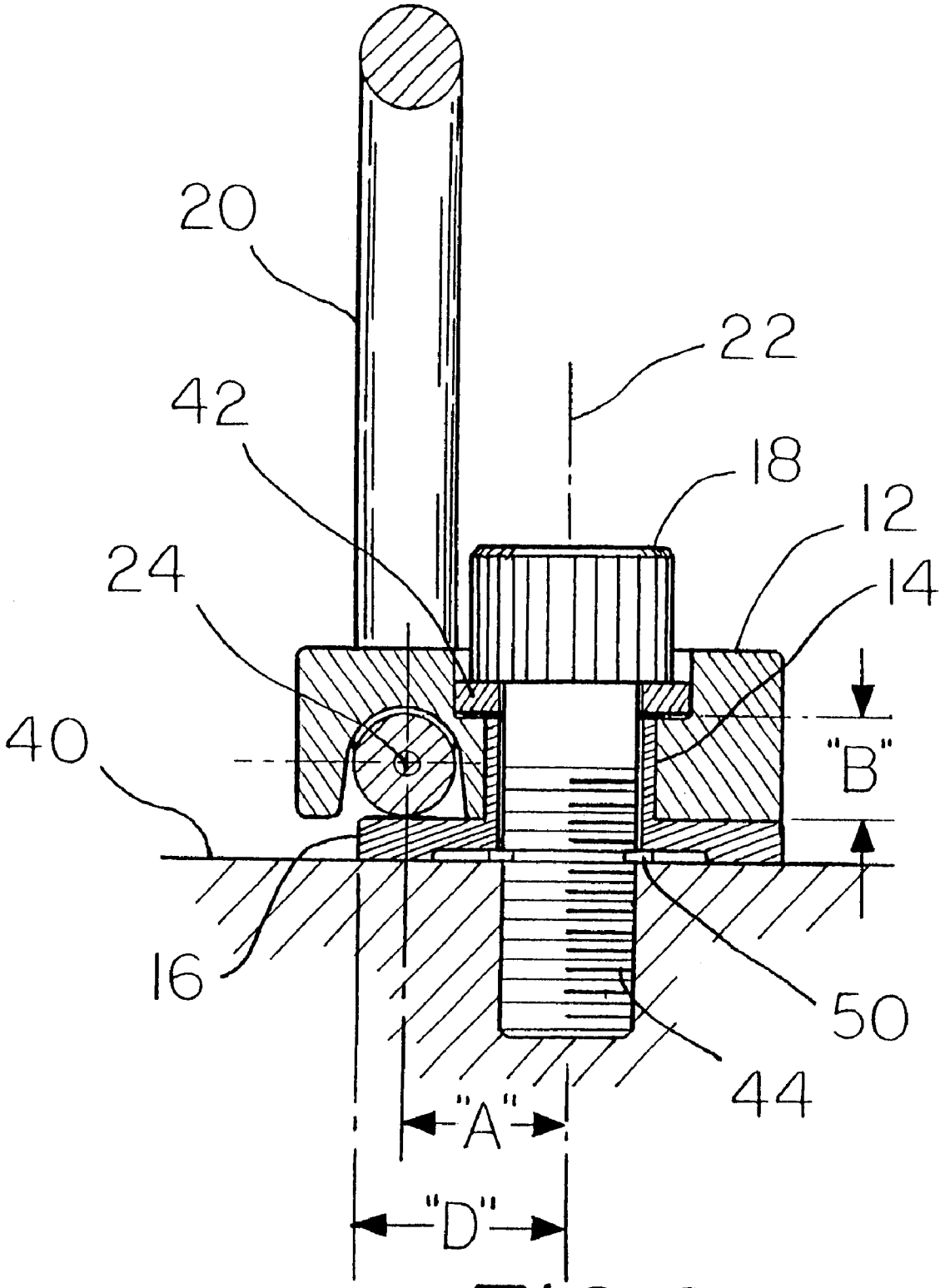
FIG. 2 is a side elevational view partially broken away of the embodiment of FIG. 1.

The cylindrical bushing 14 is received in the cylindrical bore 32, as seen, for example, in FIG. 2. The body 12 is journaled on the cylindrical bore 32 for rotation about the longitudinal axis 22 and cylindrical bushing 14. The cylindrical bushing has opposed distal and proximal ends. The proximal end is shown at 36. The distance between the distal and proximal ends is noted by dimension "C". The load bearing flange 16 is mounted generally concentrically with the longitudinal axis in a load receiving relationship with the distal end of the cylindrical bushing 14. In the embodiment shown, for example, in FIGS. 1 and 2, the load bearing flange 16 is integral with the distal end of the cylindrical bushing 14. The load bearing flange is adapted to bear against the surface 40 of a object and to at least partially close the open mouth 30 of the body 12. The load bearing flange has a object engaging radius noted as dimension "D". It is important to the present invention that the object engaging radius "D" be equal to or greater than the offset distance "A" in order to help minimize bending stresses imposed on the mounting member 18 during lifting.

In the embodiment shown, for example, in FIGS. 1 and 2, a load bearing washer 42 is provided to bear against the proximal end 36 of the cylindrical bushing. The load bearing washer may be omitted, as desired, so that the mounting member 18 can bear directly against the proximal end 36 of the cylindrical bushing. Also shown in FIGS. 1 and 2 is an optional countersink in the body which the head of the mounting member 18 resides. The countersink is not necessary in the present invention, and may be provided if desired. The mounting member 18 preferably includes a threaded portion 44 for threadably engaging an object to be lifted. A groove 46 is provided in the mounting member to accept the retaining clip 50. The retaining clip captively restrains the load bearing flange against the body and over the open mouth portion of the U-shaped channel thereby preventing the lift ring from dislodging. The groove and retaining clip are not required according to the present invention, but they do provide the added feature of keeping the hoist ring assembly together when not in use. When they are provided, it is important the groove be no deeper than the threads of the mounting member in order to prevent the inclusion of a stress concentration point in the mounting member that could cause catastrophic failure when stresses are imposed. The face of load bearing flange 16 is recessed to accommodate clip 50 so that only the load bearing flange will engage the surface of the object to be lifted, not the clip.

The lift ring 20 includes a generally linear segment 52 that is adapted to be received in the U-shaped channel 26 of the body 12. Assembly is completed by positioning the linear segment 52 of the lift ring 20 into the U-shaped channel 26 of the body 12. The cylindrical bushing 14 and load bearing flange are then placed into position relative to the body 12, thereby pivotally capturing the lift ring. The mounting member 18 and the load washer 42 (if provided) are then placed through the cylindrical bore. If the groove 46 and retaining clip 50 are provided, the retaining clip is then positioned in the groove to complete the assembly, which can then be attached to an object to be lifted.

The mounting member must be torqued to a predetermined value when attaching the side pull hoist ring assembly to an object to be lifted. Once torqued, the pre-load in the mounting member is compressively distributed through the load washer (if provided), through the cylindrical bushing, and through the load bearing flange. The length between the distal and proximal ends, noted by dimension "C", is slightly greater than the thickness of the cylindrical bore of the body, noted by dimension "B". This allows the body to freely swivel about the longitudinal axis 22. Hence the body 12 is not pre-loaded by the torquing of the mounting member to the object. In addition, the linear segment 52 of the lift ring 20 is sized slightly smaller than the U-shaped linear channel 26. This allows the lift ring 20 to freely rotate about the lateral axis 24. Provided the surface of the object surrounding the hoist assembly is flat, the lift ring can pivot through 180 degrees.

Importantly, the inherent design of the body 12 of the present invention eliminates that part of the assembly as being the limiting factor in determining the load capacity of the side mount hoist assembly. Associated with the lift ring is a combined shear cross-sectional area, as shown at 54 in FIG. 3 No matter what direction a lifting load is applied to the lift ring, this combined shear cross-sectional area remains the same. Associated with the body is an associated shear cross-sectional area. The plane of this area changes depending on the direction in which the load from the lift ring is applied to the body. Shown in FIG. 4 at 56 is the associated shear cross-sectional area when a load, shown at 60, is applied in a direction parallel with longitudinal axis 22.

Figure 5:
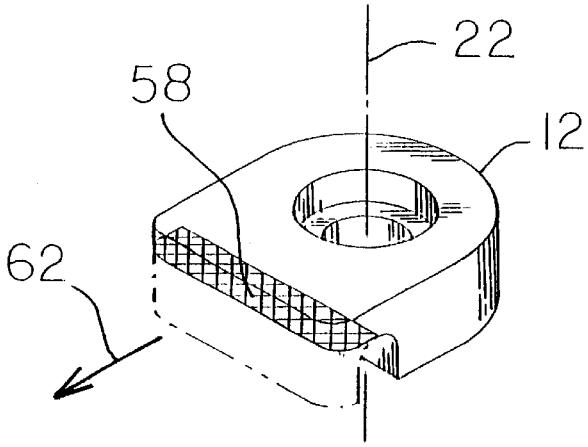
FIG. 5 is a partially phantom view of a body of the embodiment of FIG. 1 displaying its shear cross-sectional area for loads applied in a direction normal with the axis of swivel.

Shown in FIG. 5, at 58, is the associated shear cross-sectional area, when a load, shown at 62, is applied in a direction normal to the longitudinal axis 22. Importantly, the associated shear cross-sectional area of the body, regardless of the direction in which the load is applied, is always greater than the combined shear cross-sectional area of the lift ring. By making the associated shear cross-sectional area of the body, for example, many times greater than the size of the combined shear cross-sectional area of the lift ring insures that the body in no way limits the load capacity of the side pull hoist assembly. In the embodiments shown in the drawings, the ratio between the two areas is approximately about 4.0. Failure of the side pull hoist assembly, if overloaded, is designed to occur at the shear cross-sectional area of the lift ring or at the lifting member. Because these items are preferably conventional articles, the load capacity of the side pull hoist assembly is the same as the comparable capacity prior art center pull hoist assemblies discussed previously. Thus, unexpectedly, the side pull hoist assembly of the present invention, which is simpler and less expensive to make, is as strong or stronger than, comparable capacity prior art center pull hoist assemblies.

Preferably the body, cylindrical bushing, load bearing flange, and lift ring are forged from steel. No machining operations are required to accommodate the pivoting of the lift rings linear segment in the U-shaped channel. Thus, it is preferred to use the lift ring and U-shaped channel in its as forged condition. The mounting screw and bearing washer are preferably of conventional designs that are widely available as staple articles. When the load bearing flange and cylindrical bushing are integral, significant savings are achieved by forging them to near net shape prior to final machining. The surfaces needing final machining only require simple turning and boring operations.

Figure 3:
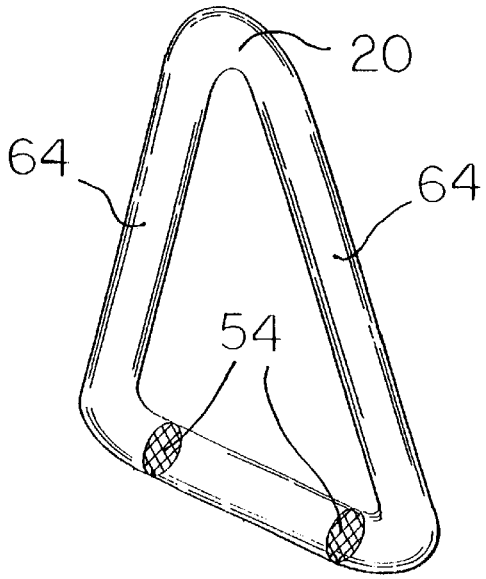
FIG. 3 is exploded view of the closed loop lift ring of the embodiment of FIG. 1 displaying its shear cross-sectional area.
Figure 4:
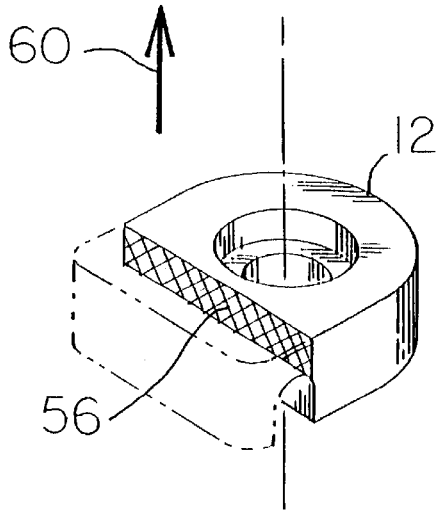
FIG. 4 is a partially phantom view of a body of the embodiment of FIG. 1 displaying its shear cross-sectional area for loads applied in a direction parallel with the axis of swivel.

In FIGS. 1 and 3, lift ring 20 includes two straight pull segments 64 that, in combination with the linear lift segment 52, establish an integral lift triangle configuration. This configuration is advantageous over the typically circular ring designs of the prior art because bending stresses in the ring are effectively eliminated. Load forces are desirably transferred in tension through the straight pull segments rather than in bending. In the preferred embodiment the lift ring is shaped in the triangle configuration and made of forged steel, and the lift ring is adapted to be used in the as forged condition. Other configurations may be used, as desired.

Significant and unexpected advantages have been discovered in the present invention. By offsetting the longitudinal and lateral axes, the complexity of the parts is significantly reduced. This not only makes them significantly easier to forge, but also minimizes expensive after forging machining operations. Although the offset induces undesirable bending stresses on the mounting member, increasing the footprint of the load bearing flange to at least the distance of the offset significantly minimizes the effects of these stresses. This allows side mount hoist ring assemblies of the present invention to have the same or greater load rating as those of comparable sized prior art center mount hoist ring assemblies.

What have been described are preferred embodiments in which modifications and changes may be made without departing from the spirit and scope of the accompanying claims.

Obviously many modifications and variations of the present invention are possible in light of the above teachings. It is therefore to be understood that, within the scope of the appended claims, the invention may be practiced otherwise than as specifically described.

What is claimed is:

1. An improved side pull hoist ring assembly adapted to attach to an object to be lifted, said assembly adapted to swivel through a full 360 degrees and pivot through a full 180 degrees, said assembly comprising:

a forged body having a longitudinal axis, a lateral axis, a generally cylindrical bore, and a generally U-shaped linear channel, said generally U-shaped linear channel having a generally arcuate bottom and an open mouth, said generally cylindrical bore extending generally concentrically with said longitudinal axis and having an axial length, said generally U-shaped linear channel extending generally linearly along said lateral axis, said lateral axis extending generally normal to said longitudinal axis and offset from said longitudinal axis by an offset distance, said generally U-shaped linear channel having an as-forged shape and a final shape, said as-forged and final shapes being the same;

a generally cylindrical bushing adapted to being rotably received in said generally cylindrical bore, said cylindrical bushing being adapted to being mounted generally concentrically about said longitudinal axis, said generally cylindrical bushing having distal and proximal opposed ends spaced apart at an axial distance, said axial distance greater than said axial length of said cylindrical bore; and a mounting member adapted to extend through said bushing to engage said object and apply a load to said proximal end of said generally cylindrical bushing, and a forged lift ring including a generally linear continuous segment, said generally linear continuous segment being adapted to being received in said generally U-shaped linear channel for pivotal rotation about an axis of rotation, said axis of rotation being generally coextensive with said lateral axis, said lift ring having an as-forged shape and a final shape, said as-forged and final shapes being the same, said forged lift ring having a combined shear cross-sectional area, and said forged body having an associated shear cross-sectional area, said associated shear cross-sectional area being greater than said combined shear cross-sectional area;

a load bearing flange adapted to being mounted generally concentrically of said longitudinal axis in a load receiving relationship to said distal end of said cylindrical bushing, said mounting member being adapted to extend through said load bearing flange, said load bearing flange being adapted to bear against a surface of said object and to captively retain said lift ring within said U-shaped linear channel by at least partially closing said open mouth.

2. A side pull hoist ring assembly of claim 1 wherein said load bearing flange is integral with said distal end of said generally cylindrical bushing.

3. A side pull hoist ring assembly of claim 1 wherein said load bearing flange is generally annular and has a flange radius, said flange radius being at least equal to said offset distance.

4. A side pull hoist ring assembly of claim 1 wherein said lift ring further comprises two generally straight pull segments, said linear lift segment and said straight pull segments establishing an integral lift triangle configuration, said lift ring being made of forged steel.

5. A side pull hoist ring assembly of claim 4 wherein said forged body is made of forged steel.

6. A side pull hoist ring assembly of claim 1 wherein there is a ratio between said associated shear cross-sectional area of said forged body, and said combined shear cross-sectional area of said forged lift ring, said ratio being at least 4.0.

7. A side pull hoist ring assembly of claim 1 further comprising:

a retaining clip being adapted to snappedly engage a groove in said mounting member thereby captively restraining said load bearing flange.

* * * * *